US006006368A

United States Patent [19]

Phillips

[11] Patent Number: 6,006,368

[45] Date of Patent: Dec. 28, 1999

[54] COMBINATION HELMET AND SHOULDER PAD FOR MINIMIZING CERVICAL INJURIES

[76] Inventor: Richard L. Phillips, 1005 Rhett Dr., Kennesaw, Ga. 30144

[21] Appl. No.: 09/057,856

[22] Filed: Apr. 9, 1998

[51] Int. Cl.[6] ..... A42B 3/00; A41D 13/00

[52] U.S. Cl. ..... 2/468; 2/462; 2/464; 2/425; 2/421

[58] Field of Search ..... 2/455, 468, 425, 2/462, 461, 464, 422, 44, 45, 421; 602/17, 18

[56] References Cited

U.S. PATENT DOCUMENTS

| | | | |
|---|---|---|---|
| 3,134,106 | 5/1964 | Shaffer et al. | 2/425 |
| 3,873,996 | 4/1975 | Varteressian | 2/421 |
| 3,900,896 | 8/1975 | Ackerman | 2/425 |
| 5,123,408 | 6/1992 | Gaines . | |
| 5,261,125 | 11/1993 | Cartwright et al. | 2/425 |
| 5,272,770 | 12/1993 | Allen et al. . | |
| 5,371,905 | 12/1994 | Keim | 2/425 |
| 5,444,870 | 8/1995 | Pinsen . | |
| 5,517,699 | 5/1996 | Abraham, II . | |
| 5,546,601 | 8/1996 | Abeyta . | |
| 5,581,816 | 12/1996 | Davis | 2/425 |
| 5,581,820 | 12/1996 | Cartwright et al. | 2/425 |
| 5,715,541 | 2/1998 | Landau | 2/425 |

*Primary Examiner*—Michael A. Neas
*Attorney, Agent, or Firm*—Kenneth L. Tolar

[57] ABSTRACT

The present invention relates to a combination shoulder pad and helmet assembly uniquely designed to protect a user from serious cervical spine injuries. The device comprises a helmet having a mounting bracket on the back portion thereof The mounting bracket has a pair of opposing embrasures in communication with and an axial, cylindrical bore. An elongated tubular rod is received within the bore having an indention at opposing ends thereof. The rod is retained within the bore using a spring biased pin received within the embrasures and the indention which also limits the rotation of the rod relative to the cylindrical bore. The spring biased pin has a concave portion proximal its head which may be selectively aligned with the rod indention to release the rod from the brackets. The opposing end of the rod is secured to a similar bracket and pin mechanism mounted to the top edge of a set of shoulder pads. Furthermore, a mid-torso protective device is secured to the lower edge of the shoulder pads. The assembly is designed to limit the movement of a football player's head relative to the body to minimize the potential for serious, paralyzing cervical injuries as well as to protect the player from breath taking blows to the abdomen.

7 Claims, 2 Drawing Sheets

COMBINATION HELMET AND SHOULDER PAD FOR MINIMIZING CERVICAL INJURIES

BACKGROUND OF THE INVENTION

The present invention relates to a shoulder pad and helmet assembly, and more specifically, a shoulder pad and helmet assembly designed primarily for younger players that limits movement of the head relative to the shoulders thereby minimizing the potential for cervical injuries.

DESCRIPTION OF THE PRIOR ART

Football can be an extremely dangerous sport in that a player frequently receives violent blows to the head. Several players each year at all levels incur serious, sometimes paralyzing neck and back injuries as a result of collisions with other football players. These injuries typically occur because the player's head is impacted with a tremendous amount of force causing the head, and thus the cervical spine, to move relative to the player's body. In some instances, the head receives a force co-linear with the spine causing it to compress resulting in temporary or permanent paralysis.

Although various devices for minimizing movement of a football player's head exist in the prior art, none of these devices have the unique features and advantages of the present invention. For example, U.S. Pat. No. 5,546,601 issued to Abeyta relates to a protector designed to disperse external forces away from the neck and spine. The device includes a U-shaped upper structure for surrounding the back and opposite sides of the neck with a head protector and a lower structure mounted thereto for dispersing forces from the head to the shoulders.

U.S. Pat. No. 5,517,699 issued to Abraham, II discloses a protective device designed to transmit a force from the helmet to the shoulders. The device includes a hood superimposable over a helmet attached to a leaf spring and shoulder assembly to transmit forces from the head to the shoulders.

U.S. Pat. No. 5,444,870 issued to Pinsen relates to a football helmet and shoulder pad combination having a neck assembly attached to the helmet that limits head tilt and rotation. The neck assembly comprises substantially circular inner and outer spherical guides surrounding a concentric movable inner element. The movement of the inner element is limited by stops within the guides.

U.S. Pat. No. 5,272,770 issued to Allen et al discloses a head restraining system comprising a helmet, shoulder plate and a plurality of straps for attaching the helmet to the shoulders, chest and back areas of the plate for restraining a race car driver's head.

U.S. Pat. No. 5,123,408 issued to Gaines relates to a flexible sports brace designed to transfer excessive force to a football player's shoulder pads. The device comprises a helmet with two semi-circumferential support bands attached thereto with a compression resistant cervical brace slidable between the bands.

The above described devices each comprise a significant number of interrelated parts including straps, springs and harnesses and are therefore difficult and time consuming to mount on a user's body or to remove therefrom. Furthermore, none of these devices include a special protector attached to the shoulder pads for protecting the user from blows to the mid-torso. The present invention provides a uniquely designed shoulder pad and helmet assembly that employs a quick release, spring biased mechanism that limits lateral movement of the head relative to the shoulders and also prevents compression of the spine. Furthermore, the quick release feature allows a user to quickly detach the helmet or shoulder pads from the spring biased mechanism to assist a user in mounting or removing the device.

SUMMARY OF THE INVENTION

The present invention relates to a combination shoulder pad and helmet assembly designed primarily for younger players to minimize serious spinal injuries as well as less serious injuries to the abdomen. The device comprises a helmet of the type generally known in the prior art having a wing shaped attachment bracket on its back surface. The wing shaped attachment bracket has a cylindrical, axial bore therethrough with a pair of embrasures on opposing sides thereof. Received within the axial bore is a tubular rod having an indention proximal each end thereof. A spring biased pin is received within the embrasures on the mounting bracket as well as an indention on the tubular rod. A similar mounting bracket and spring biased pin mechanism is attached to the upper edge of a pair of shoulder pads for receiving and securing the opposing end of the tubular rod. The rod and pin mechanism limits the movement of the helmet relative a user's shoulders and minimizes the compression of the cervical spine upon impact. Each pin also has a concave portion proximal an end thereof which may be selectively aligned with an indention on the tubular rod to allow the rod to be easily released from either bore. The bottom edge of the shoulder pads also includes a releasable shield for protecting the mid-torso from breathtaking blows thereto. It is therefore an object of the present invention to provide a combination shoulder pad and helmet assembly having a mechanism designed to limit the movement of the head relative to the body.

It is yet another object of the present invention to provide a cervical protector mechanism which may be quickly and easily attached to either a shoulder pad or helmet.

It is yet another object of the present invention to provide a combination shoulder pad and helmet assembly having an abdomen shield thereon for protecting a user's mid torso. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
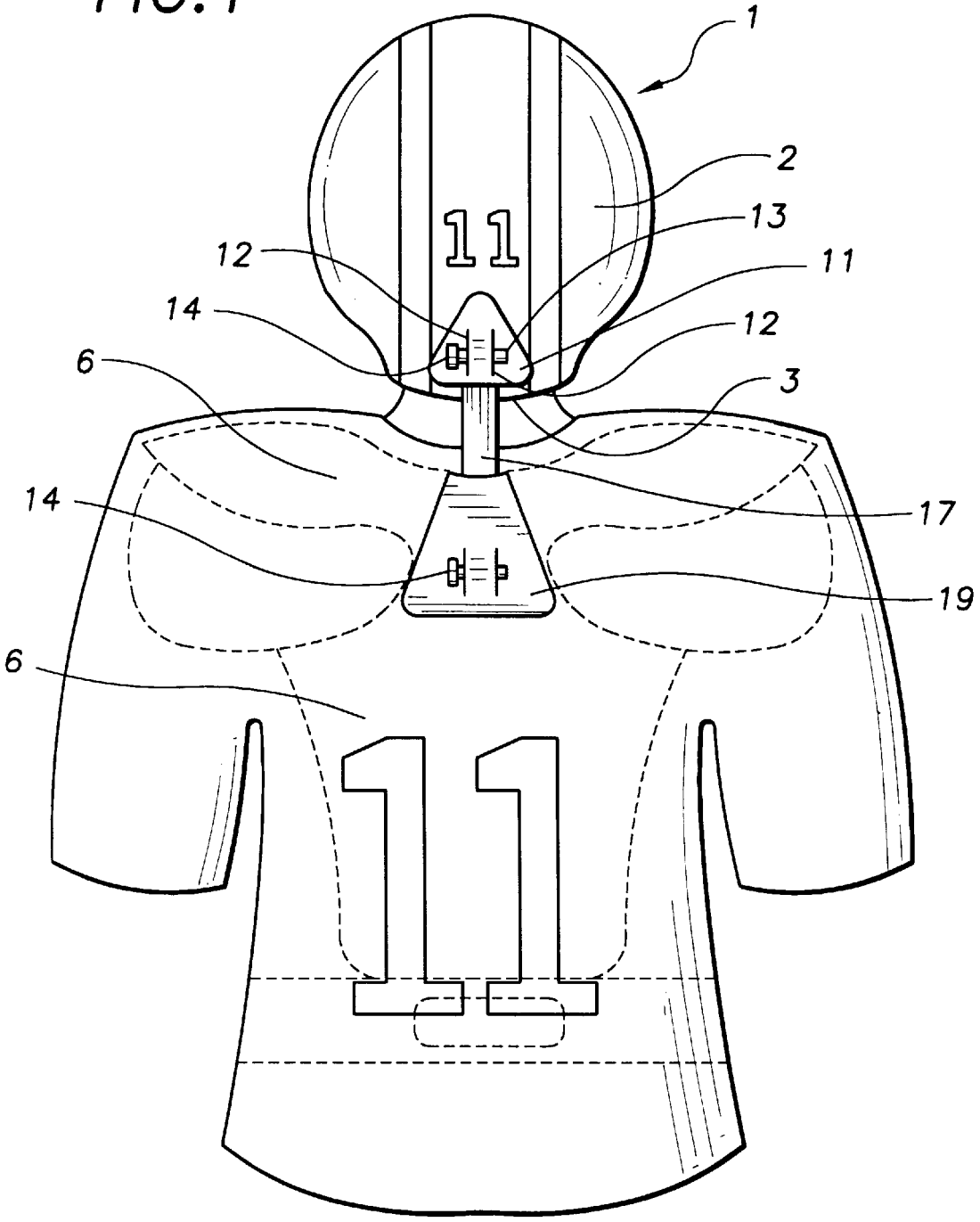
FIG. 1 is a rear view of the inventive device with the shoulder pads and abdomen shield depicted in phantom.

Referring now to FIGS. 1 through 4, the present invention relates to a combination shoulder pad and helmet assembly for a football player designed to minimize movement of the head relative to the shoulders when the head is impacted. The device comprises a conventional football helmet 1 of the type generally known in the prior art including a protective shell 2 for encasing a user's head with neck 3 and face openings and a face mask superimposed on the face opening.

Also included are conventional shoulder pads 6 of the type generally known in the prior art. The pads have a back protector portion 7, shoulder portions 8 and a chest protector portion 9 with a neck opening intermediately disposed on the shoulder portion. The chest protector portion 9 is separable and is typically joined with laces 10 or a similar attachment means.

On the back portion of the helmet adjacent the of the neck opening is a wing shaped attachment bracket 11 having a cylindrical, axial bore therethrough accessible via an aperture on the bracket's bottom surface. On opposing sides of the bracket are a pair of embrasures 12 in communication with the bore for receiving a spring biased pin mechanism as described in more detail below.

Received within the bore is a substantially tubular rod 17 having two opposing ends with an indention 18 proximal each end thereof. A second mounting bracket 19 facing the first bracket 11 is secured to the upper edge of the shoulder pads preferably on the back protector portion thereof adjacent the neck opening for receiving the opposing end of the tubular rod.

The rod is secured within each axial bore using a pin 13. The pin 13 is substantially cylindrical having a flat head 14 at one end with a concave portion 16 proximal thereto and a circumferential circular groove 25 proximal the opposing end. The pin 13 is received within the opposing embrasures and an indention on the rod. A spring 26 is received within one of the embrasures and abuts the pin head to bias the pin away from the longitudinal axis of the rod. An annular retaining clip 27 is secured within the pin groove and seats within the opposing embrasure to retain the pin within the bore. Accordingly, to attach or remove the rod from either the shoulder pads or helmet, a user pushes the pin head towards the tubular rod until the concave portion of the pin vertically aligns with the indention on the tubular rod. The tubular rod may then be easily released from the cylindrical bore on the mounting bracket.

Figure 3:
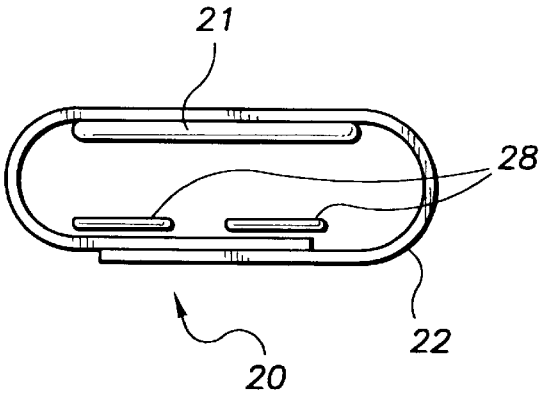
FIG. 3 is a top view of the abdomen shield according to the present invention.
Figure 4:
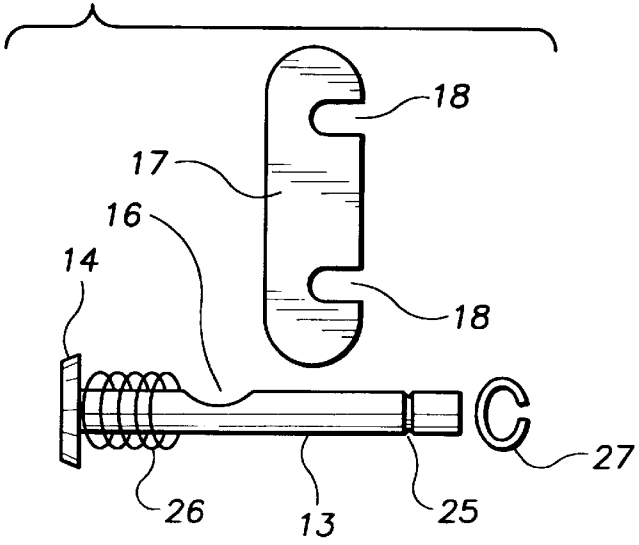
FIG. 4 depicts the pin and tubular rod according to the present invention.
Figure 2:
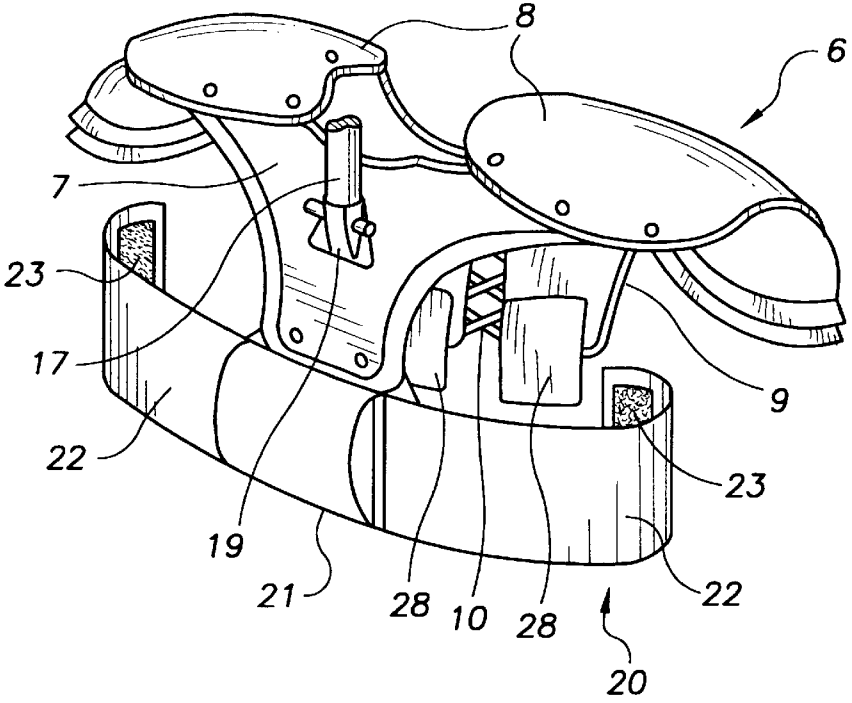
FIG. 2 depicts the shoulder pads according to the present invention.

Also provided is a mid-torso protection assembly 20 for protecting a user from severe blows to the diaphragm and surrounding area which often result in temporary loss of breath, commonly referred to as "having the wind knocked out." Extending from the lower edge of the back protector portion of the shoulder pads and is an extension pad 21 which abuts a user's back. Depending from opposing sides of the pad are a pair of straps 22 each having a VELCRO® portion 23 at a distal end on an inwardly facing side thereof. Downwardly depending from the lower edges of the chest protector portions on opposing sides of its separable seam are a pair of extension pads 28 each having a VELCRO® portion on an outwardly facing side thereof. Preferably, one or both straps have an intermediately disposed VELCRO® portion on an outwardly facing side allowing the straps to be secured in an overlapping fashion as depicted in FIG. 3. Accordingly, each strap may be wrapped to encircle a user's mid-abdomen and attached to the front mounted pads by securing its VELCRO® portions to those on the pads or the opposing strap. The straps not only protect a user's abdomen, but eliminate the need for the uncomfortable straps on conventional football shoulder pads that are secured beneath a user's armpits.

The tubular rod is preferably manufactured with a rigid but slightly flexible, rubberized material while the pin is preferably manufactured with stainless steel. The embrasures are tapered to retain the spring and retaining clip while allowing a user to insert a finger therein to manipulate the pin. The tubular rod may be dimensioned to fit users of various heights. In the preferred embodiment, the indentions on the tubular rod are shaped and dimensioned to allow the user's head to rotate approximately one hundred eighty degrees relative to the shoulders or the indentions may be dimensioned to allow any desired degree of rotation. The pin and spring are dimensioned such that the concave portion will normally be offset from the rod indentions but may be selectively aligned therewith by sliding the pin a predetermined distance. However, as will be readily apparent to those skilled in the art, the size, shape and materials of construction of the various components may be varied without departing from the spirit of the present invention.

From the above description, it is now apparent that the present invention provides a uniquely configured helmet and shoulder pad assembly that limits movement of the head relative to a user's body and minimizes compression of the cervical spine upon the head being impacted. Furthermore, the device prevents a user from putting the head down which otherwise increases the potential for serious injury. In addition, the device prevents a helmet from inadvertently becoming dislodged from a user's head.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination shoulder pad and helmet assembly comprising:

a protective spherical shell for receiving and protecting a user's head having a back portion;

a mounting bracket secured to the back portion of said shell having a cylindrical, axial bore therethrough and a pair of embrasures each on an opposing side thereof in communication with said bore;

a tubular rod received within said bore having an indention proximal each end thereof;

a pin received within one of said indentions and said opposing embrasures for limiting the rotation of said tubular rod within said cylindrical bore and for securing said rod therewithin;

a shoulder protecting device having a second attachment bracket thereon, likewise having a cylindrical, axial bore and a pair of embrasures each on an opposing side thereof in communication with said bore for receiving the opposing end of said tubular rod;

a second pin received within said opposing embrasures and the other of said indentions on said tubular rod for limiting the degree of rotation of said rod within said cylindrical bore and for securing said rod therewithin.

2. A combination shoulder pad and helmet assembly according to claim 1 wherein said pins further comprise a concave portion proximal an end thereof for selectively aligning with said indentions to release said tubular rods from said bores.

3. A combination shoulder pad and helmet assembly according to claim 2 wherein said pins each further comprise a circular groove proximal an end opposite said concave portion for receiving a retaining means to retain said pins within said embrasures.

4. A combination shoulder pad and helmet assembly according to claim 2 further comprising a spring surrounding said pin and received within an embrasure for biasing said pin in a direction perpendicular to the longitudinal axis of said rod.

5. A combination shoulder pad and helmet assembly according to claim 3 wherein said retaining means includes an annular ring secured within said groove and selectively received within an embrasure.

6. A combination shoulder pad and helmet assembly according to claim 1 further comprising an abdomen shield attached to a lower edge of said shoulder protector device for protecting a user's abdomen.

7. A combination shoulder pad and helmet assembly according to claim 6 wherein said abdomen shield comprises a pad having two opposing edges secured to a back lower edge of said shoulder protecting device;

a strap depending from each opposing edge of the pad each having a hook and loop fastener thereon;

a pair of chest protective panels on a front side of said shoulder protective device having hook and loop fasteners thereon for selectively engaging the hook and loop fasteners on the straps.

* * * * *